US005557381A

United States Patent [19]

Sakamoto et al.

[11] Patent Number: 5,557,381

[45] Date of Patent: Sep. 17, 1996

[54] DEVELOPER SUPPLYING UNIT WITH MULTIPLE CONTAINERS

[75] Inventors: Kazuhiro Sakamoto, Toyokawa; Kuniya Matsuura, Toyohashi, both of Japan

[73] Assignee: Minolta Co., Ltd., Osaka, Japan

[21] Appl. No.: 412,929

[22] Filed: Mar. 29, 1995

[30] Foreign Application Priority Data

Mar. 30, 1994 [JP] Japan ..... 6-060890

[51] Int. Cl.[6] ..... G03G 15/08

[52] U.S. Cl. ..... 355/260; 220/501; 222/325; 222/DIG. 1

[58] Field of Search ..... 355/206; 220/501, 220/23.4; 222/DIG. 1, 143, 325

[56] References Cited

U.S. PATENT DOCUMENTS

| | | | |
|---|---|---|---|
| 4,212,264 | 7/1980 | Knechtel et al. | 118/653 |
| 4,941,022 | 7/1990 | Ohmura et al. | 355/260 X |
| 5,296,900 | 3/1994 | Saijo et al. | 355/260 |
| 5,307,117 | 4/1994 | Harlan | 206/389 X |
| 5,345,298 | 9/1994 | Corrigan, Jr. | 355/260 |

FOREIGN PATENT DOCUMENTS

| | | |
|---|---|---|
| 64-35574 | 2/1989 | Japan . |
| 1-85850 | 7/1989 | Japan . |
| 2-186375 | 7/1990 | Japan . |

*Primary Examiner*—Joan H. Pendegrass
*Assistant Examiner*—Sophia S. Chen
*Attorney, Agent, or Firm*—Burns, Doane, Swecker & Mathis, LLP

[57] ABSTRACT

A developer supplying container of cylindrical shape which is connectable in a direction of its rotational axis. The container having a developer sending aperture on a base, a developer receiving aperture on the opposite base, and a connecting member to detachably connect the container to a second container having the same construction as the former container. The developer accommodated in the former container is transported to the second container through the developer sending aperture of the former container and a developer receiving aperture of the second container, and supplied to the developing device with the developer accommodated in the second container. When the developer accommodated in the former container is exhausted, only the former container should be replaced.

11 Claims, 3 Drawing Sheets

DEVELOPER SUPPLYING UNIT WITH MULTIPLE CONTAINERS

BACKGROUND OF THE INVENTION

1. Field of the Invention

The present invention relates to a developer supplying container, and more specifically relates to a developer supplying container used in connection with a developing device or image forming apparatus employing said developing device.

2. Description of the Related Art

Developer supplying containers have been proposed wherein a container accommodating developer is connected to a developing device or image forming apparatus in a state such that a container aperture is downward facing so that the developer accommodated within the container is supplied to a developing device by falling through said aperture.

Japanese Laid-Open Patent Application Nos. SHO53-146639 and HEI3-2881 disclose developer supplying containers which transport the developer accommodated within the container along a spiral channel via the rotation of the cylindrical container provided with a spiral channel, such that said developer is delivered outside the container from an aperture provided at one end of said container. The aforesaid developer supplying containers are advantageous in that there is scant possibility of soiling the interior of the image forming apparatus or the clothing of a user due to overflow of the developer from the aforesaid aperture when installing or removing the container because the container is connected to the image forming apparatus in a horizontal state.

In the aforesaid developer supplying containers, the developer accommodated within the container is gradually supplied to the developing device so as to be depleted in accordance with the consumption of the developer by the image forming apparatus (developing device). When all of the developer accommodated within the container has been supplied to the developing device, the old empty container is removed from the image forming apparatus or the like and replaced by a new container loaded with developer.

Because toner replenishment is accomplished by replacing the container in the previously described methods, it is necessary to replace the container after all the developer accommodated within the container is supplied to the developing device and said container becomes empty so as not to waste developer remaining in the container. Therefore, the time of developer replenishment is actually limited to times when developer within the developer supplying container is completely depleted, which is disadvantageous from a maintenance perspective.

In copying apparatus, for example, service personnel from the manufacturer or dealer periodically visit the user for typical maintenance procedures such as spot inspections, parts replacement, developer replenishment and the like. At such times, the previously described methods are not capable of toner replenishment even when the developer within the developer supplying container is depleted to the extent that there is not sufficient remaining developer to last until the next service visit, thereby necessitating another visit by service personnel at a later date simply to replenish the developer, i.e., replace the container, or the user himself must replace the container. Since the replacement period is limited, developer replenishment cannot be accomplished with operational efficiency and user convenience even though the user performs the replacement.

SUMMARY OF THE INVENTION

A main object of the present invention is to provide a developer supplying container with excellent maintenance characteristics.

A further object of the invention is to provide a developer supplying container which allows complete selectivity as to the timing of developer replenishment.

A still further object of the invention is to provide a developer supplying container which reliably prevents overflow of developer from the container aperture when installing or removing the container.

These and other objects of the present invention are accomplished by a developer supplying container for transporting developer accommodated therein by its rotation, comprising a first aperture provided on a front surface of the container with respect to a direction in which the developer is transported, a second aperture provided at a back surface of the container with respect to said direction corresponding to the position of said first aperture, and a connecting member to detachably connect an another container with the present container in a direction of the rotational axis of the present container.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiment of the present invention is described hereinafter with reference to the accompanying drawings.

1) Construction

Figure 1:
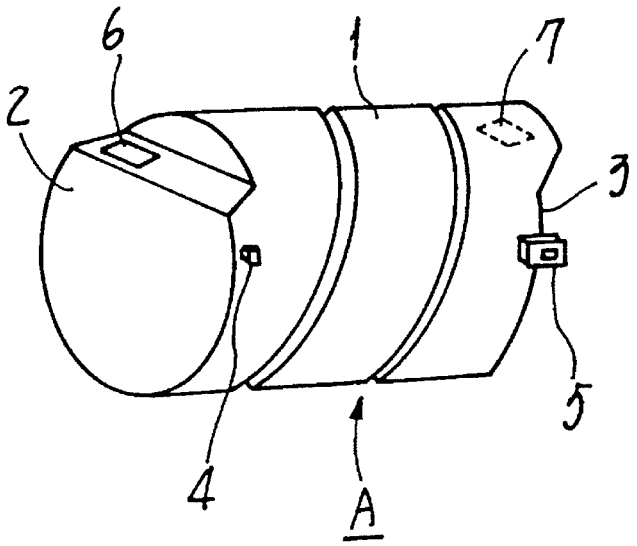
FIG. 1 is a perspective view of an embodiment of the developer supplying container of the present invention.

FIG. 1 is a perspective view showing the exterior of an embodiment of the developer supplying container.

The developer supplying container is a container for accommodating powder developer used by image forming apparatus such as copiers, printers and the like. The container supplies developer accommodated within the container to a developing device via connection to said developing device or main unit of an image forming apparatus (hereinafter, referred to as simply "the container").

Figure 3:
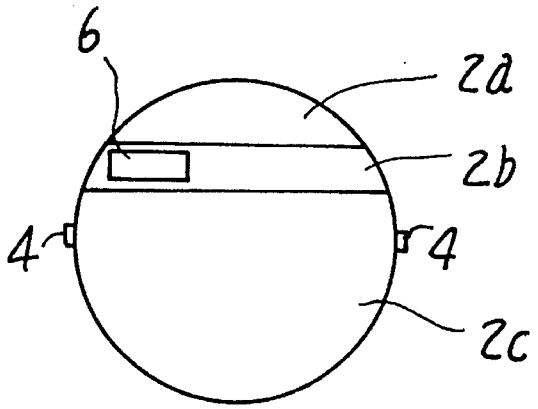
FIG. 3*a* is an elevation view of an embodiment of the developer supplying container.
FIG. 3*b* is a side view of an embodiment of the developer supplying container.
FIG. 3*c* is a rear view of an embodiment of the developer supplying container.
Figure 3:
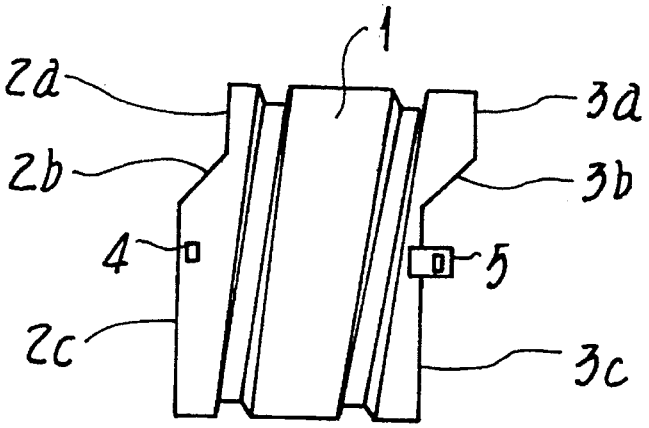
Figure 3:
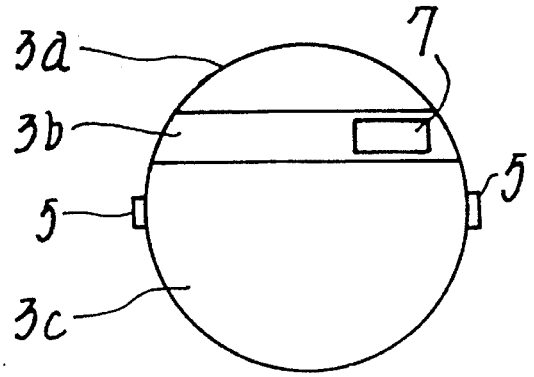

In FIG. 1, reference symbol A refers to the developer supplying container which comprises cylindrical section 1, front section 2, and rear section 3. A pair of small protrusions 4 bilaterally positioned so as to coincide with the cylindrical axis are provided near the front end (left side in FIG. 1 labeled front section 2) of the exterior circumference of cylindrical section 1, and a pair of small frames 5 coincident with the positions of small protrusions 4 are provided near the rear end (right side in FIG. 1 labeled rear section 3) (refer to FIG. 3). First aperture 6 is provided on front section 2, and second aperture 7 is provided on rear section 3 (hereinafter respectively referred to as "aperture 6" and "aperture 7").

Figure 2:
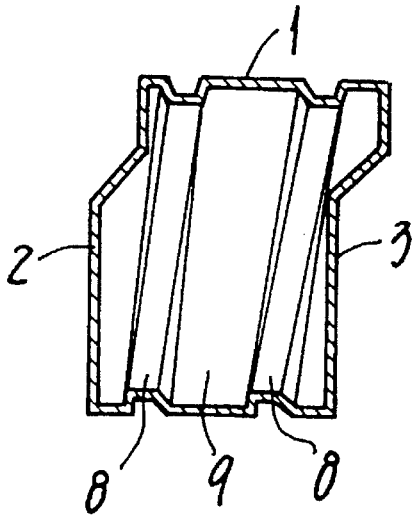
FIG. 2 is a longitudinal section view of an embodiment of the developer supplying container.

FIG. 2 is a longitudinal section view of container A.

Spiral protrusions 8 are provided on the interior circumferential surface of cylindrical section 1 facing from the rear end to the front end, and spiral channel 9 is formed between said protrusions 8. Spiral channel 9 starts near the aforesaid aperture 7 and ends near the aforesaid aperture 6.

FIGS. 3*a*, 3*b*, and 3*c* are elevation, side, and rear views, respectively.

Front section 2 comprises three connected surfaces: surfaces 2*a* and 2*c* which are perpendicular to the cylindrical axis, and surface 2*b* which is disposed between surfaces 2*a* and 2*c* and forms an obtuse interior angle with surface 2*c*. The aforesaid aperture 6 is provided at the end of surface 2*b*. Considering the balance with toner supplying rate and the like, it is preferable to position surface 2*a* is positioned uppermost.

Rear surface 3 is comprised basically the same construction as front surface 2. That is, rear section 3 comprises three connected surfaces: surfaces 3*a* and 3*c* which are perpendicular to the cylindrical axis, and surface 3*b* which is disposed between surfaces 3*a* and 3*c* and forms an obtuse interior angle with surface 3*c*. The aforesaid aperture 7 is provided at the end of surface 3*b*.

Surfaces 2*a* and 3*a*, surfaces 2*b* and 3*b*, surfaces 3*c* and 3*c* have similar configurations, and apertures 6 and 7 have similar configurations, and are positioned oppositely across cylindrical section 1. Furthermore, surfaces 2*b* and 3*b* are parallel.

The construction of front section 2 and rear section 3 are not restricted to the three-surface construction of the present embodiment insofar as aperture 6 is provided on a surface which forms an obtuse interior angle with a surface perpendicular to the cylindrical axis, and aperture 7 is provided on a surface parallel to the surface on which aperture 6 is provided, and a single surface or two-surface construction may alternatively be used. Furthermore, a four-surface or more construction may also be used.

Container A of the previously described construction when accommodating developer in its interior area, is sealed by seal members (not illustrated) covering apertures 6 and 7.

2) Operation

The container of the present invention employs a plurality of connected containers used as a single container.

Figure 4:
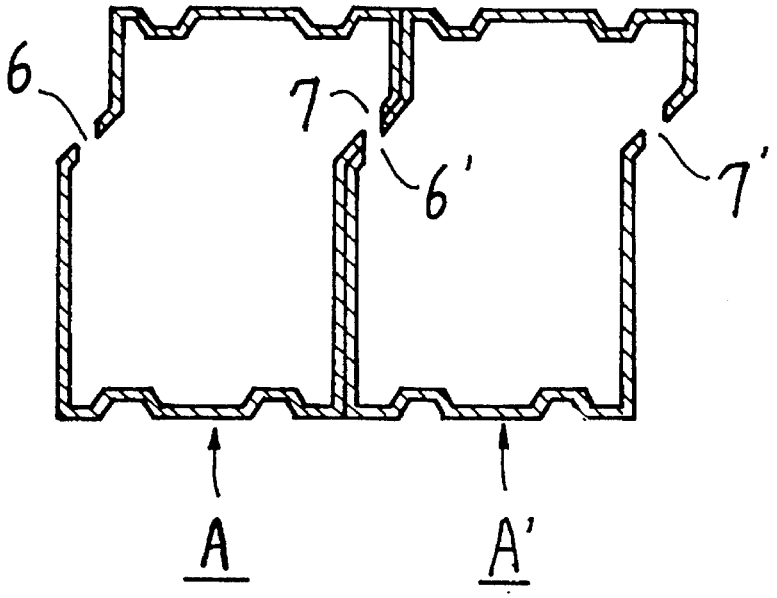
FIG. 4 is a brief section view illustrating an embodiment of the developer supplying container in a connected state.

FIG. 4 is a brief section view showing the state that two containers are connected.

For the convenience of the following discussion, the far side container (right side in FIG. 4) shall be referred to as container A', and the reference numbers of the various parts of container A' shall be referred to by the corresponding reference number of the various components of container A, i.e., cylindrical section 1' shall correspond to cylindrical section 1, aperture 6' shall correspond to aperture 6 and the like.

Containers A and A' are connected in the direction of the cylindrical axis and conjoined with no spacing between the entire surface of rear section 3 of container A and the entire surface of front section 2' of container A', such that the small protrusion 4' of container A' engages the small frame 5 of container A. At this time, the developers accommodated in containers A and A' are able to move between both containers through apertures 7 and 6'. The seal members covering apertures 7 and 6' are peeled away prior to making the aforesaid connection.

Figure 5:
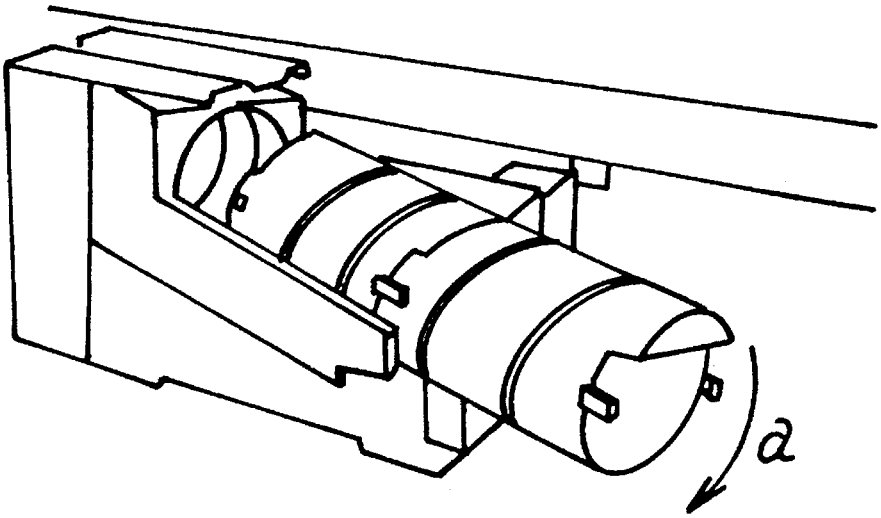
FIG. 5 is a conceptual view showing the method for connecting an embodiment of the developer supplying container.

FIG. 5 is a brief conceptual illustration of the connection of the present container to the image forming apparatus.

The connected containers A and A' (hereinafter referred to as "container unit") are connected to the image forming apparatus in a horizontal state with container A at the front. The container unit is connected so as to be freely rotatable with the cylindrical axis as the rotational axis, and is rotated in the arrow "a" direction in FIG. 5 via a drive means such as a motor or the like in linkage with the image forming operation of the image forming apparatus. The connection of the container unit with the image forming apparatus is accomplished by a common method such as that disclosed in Japanese Laid-Open Patent Application No. HEI 3-2881.

When the container unit is rotated, the developer within container A' moves along spiral channel 9' toward the front end of the container. A uniform amount of developer moves toward container A each time aperture 6' moves downward in conjunction with the rotation of the container unit. Similarly, the developer in container A moves along spiral channel 9 and gradually falls from aperture 6 to the developing device (not illustrated) within the image forming apparatus. Thus, the developer within the container unit is completely moved from container A' to container A, and from container A to the developing device in conjunction with the rotation of the container unit, thereby supplying developer to the developing device via aperture 6 of container A.

Since, as described above, the container unit employs a plurality of connected containers, the size of each individual container is necessarily smaller than the size of conventional containers. Although two individual containers are connected in the present embodiment, three or more containers may be connected in accordance with the size of the image forming apparatus to which they are connected.

3) Container replacement

As previously described, the developer within the container unit is gradually depleted from the container on the rear side of the connection. Accordingly, when the developer is replenished, it is not necessary to wait for the developer to be completely depleted from the entire container unit. That is, the developer within container A' moves completely to container A, and when container A' becomes empty said container A' is removed from container A, then developer is replenished by replacing said container A' with a new container loaded with developer.

The removal of container A' is accomplished when the container unit is stopped at a position wherein aperture 6' of container A' is facing upward (the position shown in FIG. 4) so as to prevent overflow of developer from said aperture 6' of container A' and aperture 7 of container A. Although aperture 7 of container A is conversely facing downward at this time, surface 3*b* on which aperture 7 is provided is set at an angle so as to form an obtuse interior angle with surface 3*a* which is perpendicular to the cylindrical axis, such that developer does not stay near aperture 7 and does not, therefore, overflow from said aperture 7.

It is convenient to control the previously mentioned drive means to stop the container unit at the aforesaid position when the image forming operation of the image forming apparatus is completed.

Although a spiral cartridge is used as the developer supplying container in the previously described embodiment, other types of cartridges may be used (for example, a cartridge may be used which is connected to a developing device or image forming apparatus with a container aperture facing downward so as to supply developer which falls to said developing device via said aperture).

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developer supplying container which transports developer accommodated therein by its rotation, comprising:

a first aperture provided on a front side of the container with respect to a direction in which the developer is transported;

a second aperture provided on a back side of the container with respect to the developer transported direction correspondingly to the posiiton of said first aperture; and a connecting member to detachably connect an another container with the present container in a direction of the rotational axis of the container.

2. The developer container as claimed in claim 1 further comprising a first surface on the front side which forms an obtuse interior angle with a surface perpendicular to the rotational axis of the container, and comprising a second surface which is provided on the back side parallel to said first surface, wherein said first aperture is provided on said first surface and said second aperture is provided on said second surface.

3. The developer container as claimed in claim 2 further comprising a spiral groove on its inner surface which extends from the vicinity of said first aperture to the vicinity of said second aperture.

4. A developer supply unit comprising:

a first container;

a second container which is replaceably connected to said first container; and a connecting member which detachably connects the second container to the first container; wherein said first container includes:

a first aperture provided on a first surface facing said second container, a second aperture provided on a second surface which is a surface other than said first surface for supplying developer therefrom, and said second container includes:

a third aperture provided on a surface facing said first container and corresponding to said first aperture for supplying the developer accommodated in the second container to said first container through said first and third apertures.

5. The developer supplying unit as claimed in claim 4, wherein said first surface of the first container facing said second container includes a portion which forms an obtuse internal angle with a surface perpendicular to the rotational axis of the cartridge.

6. The developer supplying unit as claimed in claim 4, wherein said second container further comprises a fourth aperture on a different surface from the surface having said third aperture.

7. The developer supplying unit as claimed in claim 4, wherein said first and second containers are cylindrical shaped and transports the developer by their rotation.

8. The developer supplying unit as claimed in claim 7, wherein each said first and second container comprises a spiral groove on its inner surface.

9. The developer supplying unit as claimed in claim 4, wherein the first container and the second container have substantially the same shape.

10. A cylindrical developer supplying container which transports developer accommodated therein by its rotation, comprising:

a spiral groove provided on an inner surface;

a first aperture provided on a base portion to send out the developer from the container;

a second aperture provided on an opposite base portion correspondingly with the position of said first aperture; and a connecting member which detachably connects the container to an another container in a direction of rotational axis of the container.

11. The developer supplying container as claimed in claim 10, wherein said base portion includes a first surface which forms an obtuse interior angle with a surface perpendicular to the rotational axis of the container, said opposite base portion includes a second surface which is parallel to said first surface, and said first and second apertures are provided on said first and second surfaces respectively.

* * * * *